United States Patent [19]

Romer et al.

[11] Patent Number: 4,955,938

[45] Date of Patent: Sep. 11, 1990

[54] AMMUNITION, PREFERABLY FOR USE IN HIGH-ANGLE FIRE

[75] Inventors: Rudolf Romer, Kaarst; Wilfried Becker, Düsseldorf; Bernhard Bisping, Ratingen, all of Fed. Rep. of Germany

[73] Assignee: Rheinmetall GmbH, Düsseldorf, Fed. Rep. of Germany

[21] Appl. No.: 279,236

[22] Filed: Nov. 29, 1988

Related U.S. Application Data

[63] Continuation of Ser. No. 448,508, Dec. 9, 1982, abandoned.

[30] Foreign Application Priority Data

Dec. 10, 1981 [DE] Fed. Rep. of Germany ..... 3148829

[51] Int. Cl.[5] ..... F42B 5/00; F42B 10/06; F42B 10/32; F42B 12/10

[52] U.S. Cl. ..... 102/430; 102/334; 102/473; 102/501

[58] Field of Search ..... 102/430–434, 102/439, 376, 334, 464–470, 473, 501; 244/3.24, 3.25, 3.27, 3.3

[56] References Cited

U.S. PATENT DOCUMENTS

| | | | |
|---|---|---|---|
| 1,141,042 | 5/1915 | Davis | 102/430 |
| 1,243,542 | 10/1917 | Moore | 244/3.27 |
| 1,367,464 | 2/1921 | Cook | 102/430 |
| 1,909,776 | 5/1933 | Lowy | 102/370 |
| 2,115,608 | 4/1938 | Brandt | 102/334 X |
| 2,337,658 | 12/1943 | Hick | 102/364 |
| 2,358,899 | 9/1944 | Wilson | 102/364 |
| 2,440,568 | 4/1948 | Arter | 102/430 |
| 3,177,809 | 4/1965 | Russell-French | 102/430 X |
| 3,291,049 | 12/1966 | Hitchens | 102/513 |
| 3,311,057 | 3/1967 | Quinlan et al. . | |
| 3,396,658 | 8/1968 | Scanlon, Jr. et al. . | |
| 3,530,762 | 9/1970 | Batie et al. | 102/431 |
| 3,622,103 | 11/1971 | Meier | 244/3.3 X |
| 3,720,169 | 3/1973 | Johnson et al. | 102/364 |
| 3,831,520 | 8/1974 | Bowen et al. | 102/369 |
| 3,838,644 | 10/1974 | Prochnow et al. . | |

FOREIGN PATENT DOCUMENTS

| | | | |
|---|---|---|---|
| 196232 | 3/1908 | Fed. Rep. of Germany . | |
| 306404 | 11/1921 | Fed. Rep. of Germany . | |
| 1277706 | 9/1968 | Fed. Rep. of Germany . | |
| 1578075 | 11/1970 | Fed. Rep. of Germany . | |
| 401144 | 8/1909 | France . | |
| 787867 | 9/1935 | France | 102/439 |
| 1064253 | 5/1954 | France . | |
| 327188 | 6/1936 | Italy | 102/439 |
| 443432 | 2/1970 | Japan . | |

OTHER PUBLICATIONS

Jane's Infantry Weapons, 1978, "XM174 Series of 40 mm Automatic Grenade Launchers", pp. 460–465.

"Grenade Launchers", Ground Defence International, No. 64, May 1980, pp. 17–19.

*Primary Examiner*—Charles T. Jordan
*Assistant Examiner*—Richard W. Wendtland
*Attorney, Agent, or Firm*—Spencer & Frank

[57] ABSTRACT

Ammunition preferaqbly for use in high-angle fire to be fired from a cannon suitable for flat trajectory ammunition and with direct participation of the cannon barrel, the ammunition being made of one piece as an ammunition unit having the same outer dimensions as a comparable ammunition unit which is intended to be fired from the same cannon exclusively with an essentially flat trajectory, the ammunition unit including a propellant charge and a payload projectile having a rear portion occupying a region corresponding to that occupied by a portion of the propellant charge of the comparable unit.

25 Claims, 2 Drawing Sheets

AMMUNITION, PREFERABLY FOR USE IN HIGH-ANGLE FIRE

This is a continuation of application Ser. No. 06/448,508, filed Dec. 9, 1982 now abandoned.

BACKGROUND OF THE INVENTION

The present invention relates to ammunition preferably for use in high-angle fire which is to be fired from a weapon suitable for flat trajectory ammunition the caliber of which is smaller than that of howitzers.

Ammunition of the above type is described in Ground Defense International, No. 64, May 1980, page 19, second column from the right. It is intended for use with different caliber rifles, or other weapons, with a separate propellant charge being provided for each rifle caliber. One drawback of this ammunition is that it is made of two parts. Moreover, the firing sequence realized depends on the skill of the operator. Finally there exists the drawback that the effective range on a flat path of flight is only 100 m and with the bore raised to 45° it is only 350 m.

Although Jane's Infantry Weapons, 1978, page 462, discloses cartridged ammunition of the above-mentioned type, this ammunition requires an accessory on the rifle.

SUMMARY OF THE INVENTION

It is an object of the present invention to provide ammunition of the above-mentioned type which requires no additional devices for being fired.

The above and other objects are achieved, according to the invention, by the provision of ammunition preferably for use in high-angle fire to be fired from a cannon suitable for flat trajectory ammunition and with direct participation of the cannon barrel, the ammunition being made of one piece as an ammunition unit having the same outer dimensions as a comparable ammunition unit which is intended to be fired from the same cannon exclusively with an essentially flat trajectory, the ammunition unit being composed of a propellant charge and a payload projectile having a rear portion occupying a region corresponding to that occupied by a portion of the propellant charge of the comparable unit.

The present invention will be described in greater detail below with reference to preferred embodiments that are illustrated in the drawings and with reference to advantages resulting from the invention, whereby one essential advantage relates to the fact that the projectile can be fired directly from the barrel of a machine cannon even in rapid fire without the requirement of any additional devices.

BRIEF DESCRIPTION OF THE DRAWING

All of the drawing figures are longitudinal axial views.

DESCRIPTION OF THE PREFERRED EMBODIMENTS

Figure 2:
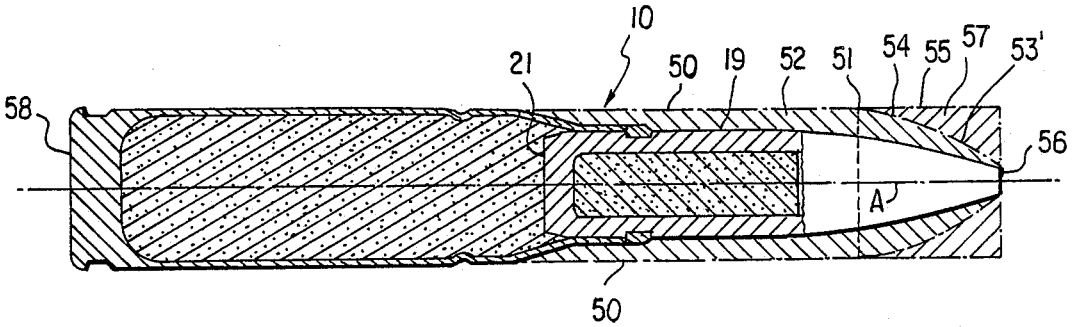
FIG. 2 shows a low trajectory ammunition unit according to the invention having an essentially circularly cylindrical shape.

As shown in FIG. 2, the ammunition unit 30 of an essentially circularly cylindrical shape has a propellant charge case or shell 32 which extends with an essentially smooth outer circumferential face 33 over its entire length from an outer shell bottom 58 to a neck 34.

An explosive projectile 36, which extends from a bottom face 39 to a tip face 59, is provided with a sealing band 46 in the region of its circumferential face 37. In its interior (not identified in detail) there is disposed an explosive charge 38.

In the interior 42 of the propellant charge shell 32 there is disposed a propellant charge 44 which extends from a bottom face 49 of the shell interior to the bottom 39 of the projectile. A circularly cylindrical part of the projectile 36 extends parallel to a longitudinal axis A to an edge plane 48 at which the circumferential face 37 intersects with an ogival face 53.

The propellant charge 44 is designed in such a manner that, when fired, the energy released therein assures an essentially flat trajectory of the explosive projectile 36 and consequently substantially contributes to its final ballistic effect in the target. The propellant charge 44 is divided into a frontal section 44' and a rear section 44'' by an imaginary plane 73', which will be discussed in greater detail below.

Figure 4:
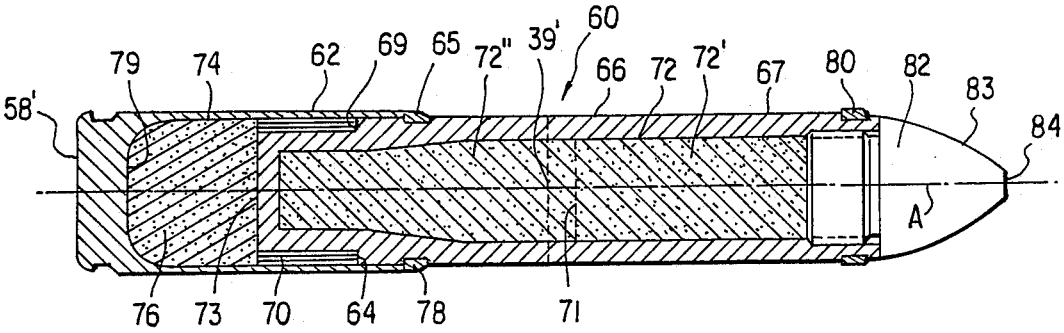
FIG. 4 shows an ammunition unit according to the invention comprising an elongated projectile and a shortened projectile charge case made of metal containing a comparably small propellant charge as a further development of the ammunition unit according to FIG. 2.

In the ammunition unit 60 shown in FIG. 4 a circularly cylindrical propellant charge shell 62 extends from an outer bottom face 58' to the frontal face 65 of a rear section 64 of a payload projectile designed as a superheavy explosive projectile 66 which extends along the longitudinal axis A between a projectile bottom 73 and a tip face 84. Shell 62 and projectile 66 together form an essentially circularly cylindrical body which extends between the bottom face 58' and a rotating or guide band 80 at the front end of the circumferential face 67 of projectile 66. At the tip, the cylindrical body is followed by the body of a ground-proximity fuze 82 having an ogival face 83.

In the interior of the explosive projectile 66 there is disposed an explosive charge 72. This charge is divided by an imaginary plane 71 into a front section 72' and a rear section 72''. The front section 72' here corresponds to the explosive charge 38 of the ammunition unit 30 of FIG. 2 which will be discussed in greater detail in the later part of this specification. Rear section 64 of the explosive projectile 66 extends from a rear sealing band 78 to the bottom 73 of the projectile.

A region having a smaller diameter extends between the projectile bottom 73 and a circular radial ring face 69 forming a step and serves as a receptacle for an extendable stabilization guide mechanism. This guide mechanism is illustrated as a wound, or coil, guide mechanism 70 but can also be designed as a known fold-out guide mechanism. A propellant charge 76 disposed in the interior 74 of the propellant charge shell 62 extends axially between the shell interior bottom face 79 and the projectile bottom 73.

The ammunition units 30 of FIG. 2 and 60 of FIG. 4 have essentially the same outer dimensions so that they can advantageously be used in one and the same weapon. A part of the front section 44' of the propellant charge 44 of the ammunition unit 30 of FIG. 2 is occupied in the ammunition unit 60 of FIG. 4 by the rear portion of the superheavy explosive projectile 60 which extends between the projectile bottom 73 and an imaginary plane 39' which corresponds in position to the bottom face 39 of FIG. 2. In this way, the illustrated ammunition unit 60 of FIG. 4 is particularly suitable for use in high-angle fire, e.g. against targets behind barriers. The barrel of the weapon in question is then elevated into the high-angle range. A highly curved flight path for the superheavy explosive charge 66 results in a sufficiently long range.

On the one hand, the propellant charge 76 of FIG. 4 is designed so that the energy released from it upon firing simply brings the superheavy explosive projectile 66 to the apex of its flight path and consequently does not contribute to the final ballistic effect in the target.

On the other hand, the explosive charge 72 which is enlarged by the rear section 72", compared to the ammunition unit 30, and its associated projectile shell section (not shown in detail) are particularly effective on a target and its effectiveness can be adapted to the requirements at hand by selection of the detonator and/or its setting. This results in high efficiency, particularly against soft targets. In this case a ground proximity fuze is preferred.

Figure 7:
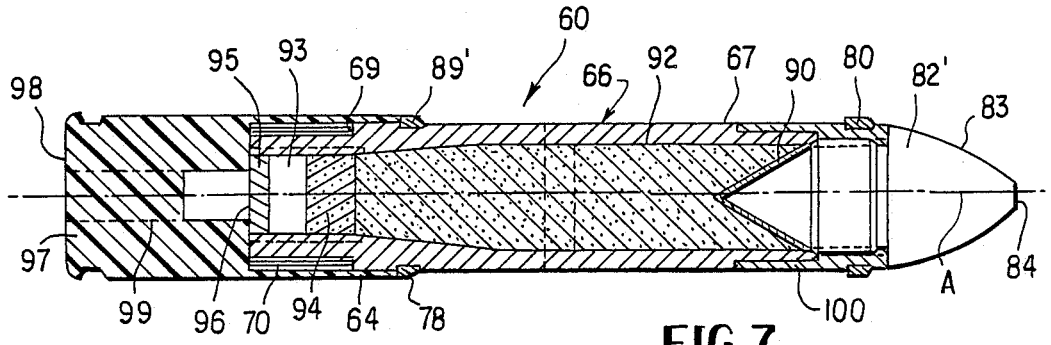
FIG. 7 shows a caseless ammunition unit according to the invention comprising a shortened combustible propellant charge, a projectile comprising a shaped charge with a liner, and an accompanying base fuze.

If the superheavy explosive projectile 66 (as shown in FIG. 7) is equipped with a shaped charge 92 which is provided with a projectile forming liner 90, it can be used—now advantageously from a defiladed firing position of the weapon in question—against massed tank groups with the armor penetrating effect being advantageously realized from the top.

In the ammunition unit according to FIG. 7, the hollow charge 92 has at its rear a ground proximity fuze 93 equipped with a detonator 94. The ground proximity fuze 93 has a screw bottom 95 with external thread (not identified in detail) and at least two holes 96 for a conventional tool. In this way, the fuze can easily be screwed into an opening equipped with an internal thread (not identified in detail) in the rear section 64 of the explosive projectile 66. The tubular front portion (not identified in detail) of a solid propellant charge body 97 encloses the rear section 64 and rests with its front face 89' against the sealing band 78. The solid propellant charge body 97 is delimited by a rear face 98. A conventional primer 99 is indicated by dashed lines. A ballistic hold 82' is disposed at the front.

If the tip face 84 of projectile 66 hits a target, for example a tank, the hollow charge 92 is caused to detonate via ground proximity fuze 93 and detonator 94 and, in a known manner, liner 90 forms itself into an armor piercing projectile.

Figure 8:
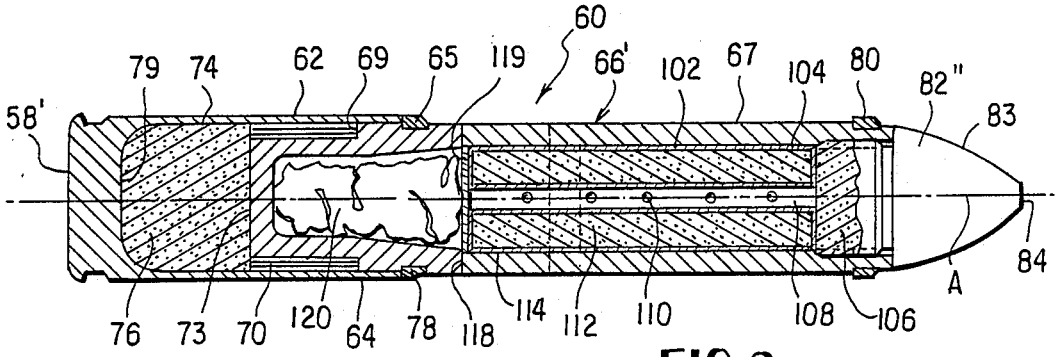
FIG. 8 shows still another ammunition unit according to the invention comprising an ejectable payload which consists of a container and a parachute.

The ammunition unit according to FIG. 8 has an ejectable payload 102 disposed in the interior of projectile 66'. The payload includes a container 104 with a known filling 112 for producing colored smoke. Container 104 has a continuous, centrally axial firing channel 108 with firing openings 110. An ejection charge 106 is disposed in front of container 104 and a plate 114 is disposed behind container 104. Plate 114 rests against a circular ring face 119 in the interior of rear section 64. Rear section 64 is connected with the major portion of projectile 66' via a known burst location 118. Behind plate 114, there is stowed a folded parachute 120. The propellant charge case corresponds to that of FIG. 4.

If projectile 66' is on its flight path, a time fuze 82" initiates ejection charge 106 at a given point in time. This not only fires filling 112 through firing openings 110, but an increasing pressure also builds up in the interior of projectile 66'. This pressure is transferred to circular ring face 119 via plate 114 to ultimately actuate the burst location 118. Rear section 64 is propelled in a direction opposite the direction of flight of projectile 66', parachute 120 unfolds and pulls container 104 out of the major portion or projectile 66 which continues its flight. Parachute 120 permits container 104 to slowly return to the ground while releasing the colored smoke from the fired filling 112. In this way, signalling effects can be produced which are visible over long distances.

Instead of filling 112 for generating colored smoke, container 104 may also contain a known filling for producing a strong lighting effect. In this way, it is possible to very effectively illuminate a given terrain at night. (In conjunction with the ammunition unit according to FIG. 8, reference is made to U.S. Pat. No. 4,002,121.)

Figure 5:
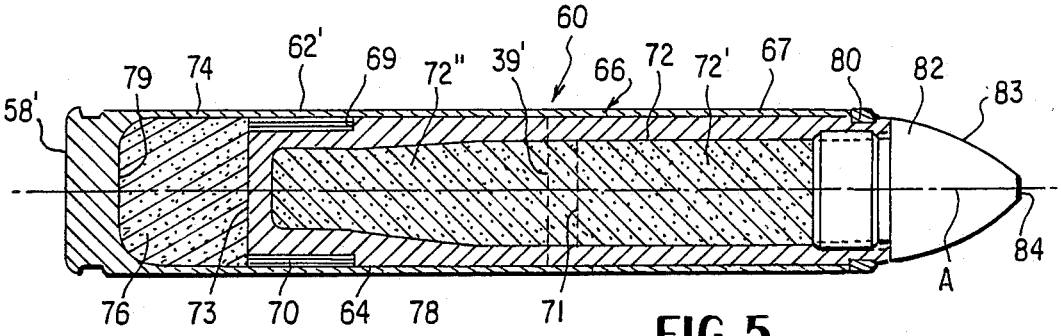
FIG. 5 shows a further ammunition unit according to the invention comprising a long propellant charge case made of metal.

The ammunition unit according to FIG. 5 differs from that according to FIG. 4 essentially only by a longer propellant charge case 62' of metal which at the front extends to guide band 80.

The advantages realized with respect to the variety of uses of a machine cannon by designing a payload projectile as a fog, smoke or light generating projectile are quite evident.

The substantial uniformity of the outer cross section of the ammunition unit 30 or 60 over essentially its entire length is of considerable importance. This will be explained in detail with reference to FIGS. 1 and 3.

Figure 1:
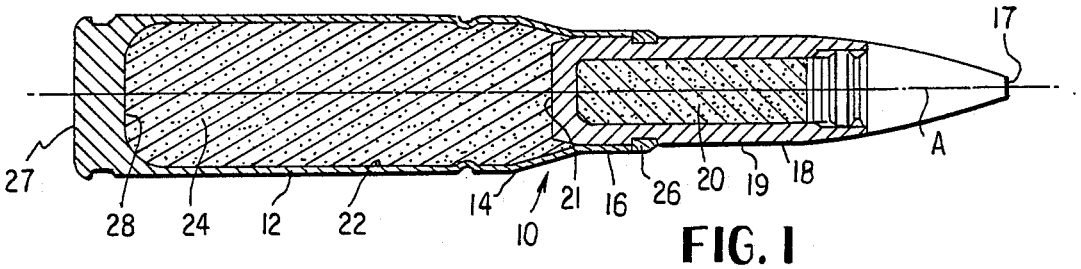
FIG. 1 (PRIOR ART)
FIG. 1 shows a prior art ammunition unit having a bottle-shaped case.

FIG. 1 shows a customarily bottle-shaped ammunition unit 10 provided with a propellant charge case 12 having a slightly conical rear section, which extends from a larger diameter end at outer bottom surface 27 of the shell to a smaller diameter end at a shoulder 14 which presents a transition to a neck 16 which has the smallest diameter. The ammunition unit 10 includes an explosive projectile 18 having a bottom face 21, a tip face 17, and a circumferential face 19. Projectile 18 contains an explosive charge 20 and carries a rear sealing, or guide, band 26.

Figure 3:
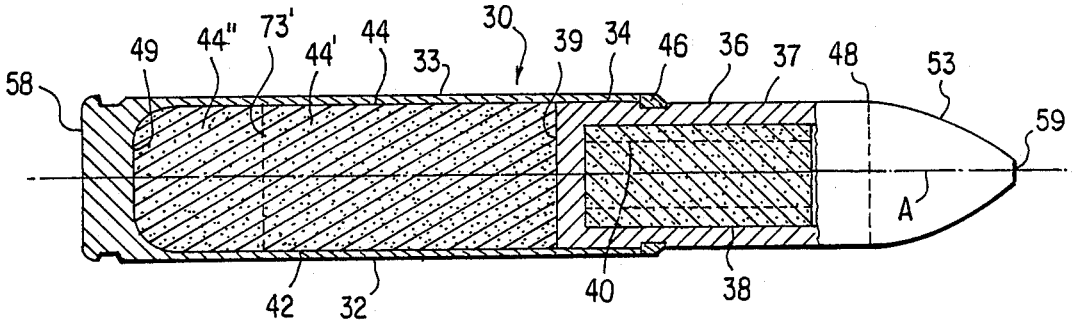
FIG. 3 shows the ammunition unit according to FIG. 1 drawn into the outer contours of the ammunition unit of FIG. 2.

In FIG. 3, the ammunition unit 10 is superimposed on the outlines of the ammunition unit 30 or 60. The slight conicity relates to an ammunition unit comprising a propellant case made of metal. After being fired the extraction of the empty case from the barrel is eased by said conicity.

Between the surface 50 of the circumferential face 37 or 67 of the ammunition unit 30 or 60 and the circumferential face 19 of the explosive projectile 18 of the ammunition unit 10 there extends an essentially circular annular cylindrical region 52 bounded at the front by a plane 51 at which the surface 53' of the ogival face 53 or 83 intersects with surface 50. Between surface 53' and the surface of the ogival face of the explosive projectile 18 there extends a further circumferential annular region 54.

The regions 52 and 54 represent a packing, or filling, volume deficit between the ammunition unit 10 and the ammunition unit 30 or 60. This deficit is a drawback in a broad sense. With reduced inner ballistic power and target effectiveness, the ammunition unit 10 requires the same space for storage and combat transport as the ammunition unit 30 or 60 whose effect is far superior. To make this even more obvious, reference is made to the parallel broken lines 40 in FIG. 2 which correspond to the circumferential face (not identified in detail) of the explosive charge 20 of ammunition unit 10. This is to illustrate the way how to render possible a significant enlargement of the explosive charge 40 of unit 30 compared with the explosive charge 20 of unit 10 of the customary bottle-shape.

In the essentially circularly cylindrical ammunition units 30 and 60 there results advantageously a small packing volume deficit, compared to uniformly circularly cylindrical bodies of the same length, as indicated in FIG. 3 by region 57 bounded by surface 53', surface 55 which is an extension of surface 50, and a surface 56 which passes through the projectile tip face at right angles to the longitudinal axis of the ammunition unit. Compared with uniformly circularly cylindrical bodies of the same length, the packing volume deficit of the ammunition unit 10 is even greater because of the additional region 54 resulting from the tip configuration of this unit. The drawback resulting from this becomes particularly evident when it is considered in connection with the interior of a vehicle, such as an armored vehicle, that such interior space is utilized particularly poorly by the ammunition unit 10. In contradistinction thereto, ammunition units 30 and 60 provide optimum utilization.

The present invention is of particular advantage in connection with cannons whose barrels can be elevated sufficiently. In this connection, automatic cannons, i.e. machine cannons, are in the foreground of such considerations because of their mobility as well as their high firing rate. Their present spectrum of use is broadened considerably and eliminates, in the field of use under consideration, i.e. ground-to-ground combat, the need for separate high-angle firearms of comparable range and caliber.

Ammunition units 30 and 60 are suitable for use in smooth as well as rifled barrels. While in the latter case, sliding guide or sealing bands must be provided, the former provides the advantages inherent in the performance-increasing use of hot and high energy propellant materials.

Contributing to an increase in performance is the use of an at least partially combustible propellant charge shell or of a propellant charge which, entirely without shell, is connected in one piece with the payload projectile, particularly since this will result in little or no empties at all in combat.

Figure 6:
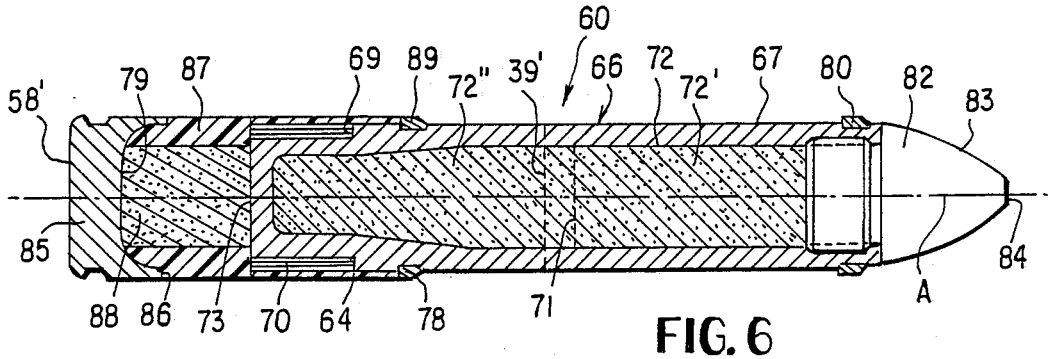
FIG. 6 shows a further ammunition unit according to the invention comprising a shortened partially combustible propellant charge case.

Compared with a combustible propellant charge case, a case made of metal is heavier, and, in addition, after firing the empty case is to be extracted from the barrel. Compared with a firing cycle related to an ammunition unit comprising a combustible propellant charge case—where no extraction is required—the extraction of the empty metal case forms an additional step within the respective firing cycle. It requires an additional device, and is possibly additionally time consuming resulting in a lower firing rate of a respective machine cannon. Keeping in mind that on the one hand the metal case itself does not take part in the effect on the target, and that on the other hand the extracted case possibly is to be stored within a respective carrier, e.g. a combat tank, the advantage of an at least partially combustible case becomes obvious. The comparably smaller empties resulting from the use of partially combustible cases (see FIG. 6), after extraction from the barrel, require much less storage place. Obviously the completely combustible propellant charge case is more advantageous.

As an example for the caseless propellant there is one of the double base type, e.g. nitrocellulose of a spherical shape (from about 40 to about 70 pet), a mixture of nitroglycerin and diglycol dinitrate to serve as a plastifier (up to about 25 pet), a two-component system on the basis of polyurethane to serve as a binder (from about 15 to about 25 pet). Known substances, one to moderate the burning characteristic of the propellant, a second one as a stabilizer for the nitrocellulose, and a third one as a catalyst for the binder, can together sum up to about 0.4 pet.

The term "superheavy" payload projectile relates to the fact that in the ammunition unit according to the invention the projectile occupies up to about 80 pet of the total volume of the unit. In comparison, in customary one-piece ammunition units for machine cannons the volume occupied by the projectile comes to a maximum of about 50 pet of the total volume of the respective unit.

The limitation to a caliber smaller than that of howitzers, the latter in the range from about 75 mm to 203 mm, indicates that the ammunition unit according to the invention is preferably designed for being fired from a machine cannon.

In an ammunition unit according to the invention designed for a caliber of, for instance, 35 mm the length of the unit is 223 mm, and the length of the payload projectile is about 180 mm.

It will be understood that the above description of the present invention is susceptible to various modifications, changes and adaptations, and the same are intended to be comprehended within the meaning and range of equivalents of the appended claims.

What is claimed is:

1. An ammunition unit for use in an automatic tubular weapon having a barrel that can be selectively oriented to effect flat trajectory or high-angle trajectory fire, said ammunition unit being constructed for one of flat trajectory fire and high-angle trajectory fire, and wherein:

said ammunition unit is a one-piece unit and comprises a propellant charge means, including at least a cylindrical member having a bottom face at one end, for providing a propellant charge, a ballistic payload projectile secured in said cylindrical member of said propellant charge means at the end thereof remote from said bottom face and having a bottom member which faces said propellant charge means and delimits the rear end of said projectile, and a payload disposed within said projectile;

said ammunition unit has a given length, outer diameter and external shape, with the portion of said projectile which projects out of said cylindrical member of said propellant charge means having substantially the same outer diameter as said cylindrical member, and with said projectile of said ammunition unit having a main cylindrical portion of constant diameter and a short ogival front end portion;

said propellant charge extends between said bottom face and said bottom member, with the quantity of said propellant charge being a function of the type of trajectory over which the ammunition is to be fired, and with the distance between said bottom member and said bottom face of said ammunition unit being greater for flat trajectory fire than for high-angle trajectory fire, and with said ammunition unit containing a greater quantity of propellant charge for flat trajectory fire than for high-angle trajectory fire;

said projectile of said ammunition unit is shorter for flat trajectory fire than for high-angle trajectory fire; and said ammunition unit has a smaller quantity of payload for flat trajectory fire than for high angle trajectory fire.

2. Ammunition for use in an automatic tubular weapon having a barrel that can be selectively oriented to effect flat trajectory or high-angle fire, said ammunition comprising a first ammunition unit constructed for flat trajectory fire and a second ammunition unit constructed for high-angle fire, and wherein:

each said ammunition unit is a one-piece unit and comprises a propellant charge means, including at least a cylindrical member having a bottom face at one end, for providing a propellant charge, a ballistic payload projectile secured in said cylindrical member of said propellant charge means at the end thereof remote from said bottom face and having a bottom member which faces said propellant charge means and delimits the rear end of said projectile, and a payload disposed within said projectile;

said first and second ammunition units are substantially identical to one another in length, outer diameter and external shape;

the distance between said bottom member and said bottom face of said first ammunition unit is greater than the corresponding distance of said second ammunition unit;

said first ammunition unit contains a greater quantity of propellant charge than does said second ammunition unit;

said projectile of said first ammunition unit is shorter than said projectile of said second ammunition unit;

said first ammunition unit has a smaller quantity of payload than does said second ammunition unit;

for each said ammunition unit, the portion of said projectile which projects out of said cylindrical member of said propellant charge means has substantially the same outer diameter as said cylindrical member; and said projectile of each said ammunition unit comprises a main cylindrical portion of constant diameter and a short ogival front end portion.

3. Ammunition as defined in claim 2 wherein said propellant charge means of at least one of said first and second ammunition units comprises a propellant charge case, which constitutes said cylindrical member, and a propellant charge disposed in said case.

4. Ammunition as defined in claim 2 wherein said propellant charge means of at least one of said first and second ammunition units comprises a solid caseless propellant charge which forms said cylindrical member.

5. Ammunition for use in an automatic tubular weapon having a barrel that can be selectively oriented to effect flat trajectory or high-angle fire, said ammunition comprising a first ammunition unit constructed for flat trajectory fire and a second ammunition unit constructed for high-angle fire, wherein:

each said ammunition unit is a one-piece unit and comprises a solid caseless propellant charge having a bottom face at one end, a ballistic payload projectile secured in said propellant charge at the end thereof remote from said bottom face and having a bottom member which faces said propellant charge and delimits the rear end of said projectile, and a payload disposed within said projectile;

said first and second ammunition units are substantially identical to one another in length, outer diameter and external shape;

said propellant charge of said first ammunition unit is longer than said propellant charge of said second ammunition unit, and contains a greater quantity of propellant charge than does said second ammunition unit;

the distance between said bottom member and said bottom face of said first ammunition unit is greater than the corresponding distance of said second ammunition unit;

said projectile of said first ammunition unit is shorter than said projectile of said second ammunition unit;

said first ammunition unit has a smaller quantity of payload than does said second ammunition unit;

for each said ammunition unit, the portion of said projectile which projects out of said propellant charge has substantially the same outer diameter as said propellant charge; and said projectile of each said ammunition unit comprises a main cylindrical portion of constant diameter and a short ogival front end portion.

6. Ammunition as defined in claim 5 wherein said payload projectile of at least said second ammunition unit is an explosive projectile.

7. Ammunition as defined in claim 6 wherein said payload projectile of said second ammunition unit includes at least one shaped charge provided with a projectile forming liner.

8. Ammunition as defined in claim 5 wherein said projectile of said second ammunition unit further includes an extendable flight path stabilizing tail unit connected to said projectile adjacent the rear end of said projectile.

9. Ammunition for use in an automatic tubular weapon having a barrel that can be selectively oriented to effect flat trajectory or high-angle fire, said ammunition comprising a first ammunition unit constructed for flat trajectory fire and a second ammunition unit constructed for high-angle fire, and wherein:

each said ammunition unit is a one-piece unit and comprises a propellant charge case having a bottom face at one end, a propellant charge within said case, a ballistic payload projectile secured in said case at the end thereof remote from said bottom face and having a bottom member which faces said propellant charge and delimits the rear end of said projectile, and a payload disposed within said projectile;

said first and second ammunition units are substantially identical to one another in length, outer diameter and external shape;

the distance between said bottom member and said bottom face of said first ammunition unit is greater than the corresponding distance of said second ammunition unit;

said first ammunition unit contains a greater quantity of propellant charge than does said second ammunition unit;

said projectile of said first ammunition unit is shorter than said projectile of said second ammunition unit;

said first ammunition unit has a smaller quantity of payload than does said second ammunition unit;

for each said ammunition unit, the portion of said projectile which projects out of said case has substantially the same outer diameter as said case; and said projectile of each said ammunition unit comprises a main cylindrical portion of constant diameter and a short ogival front end portion.

10. Ammunition as defined in claim 9 wherein said projectile of said second ammunition unit further includes an extendable flight path stabilizing tail unit connected to said projectile adjacent the rear end of said projectile.

11. Ammunition as defined in claim 9 wherein said payload projectile of at least said second ammunition unit is an explosive projectile.

12. Ammunition as defined in claim 11 wherein said payload projectile of said second ammunition unit includes at least one shaped charge provided with a projectile forming liner.

13. Ammunition as defined in claim 9 wherein said payload projectile of said second ammunition unit is a smoke producing projectile.

14. Ammunition as defined in claim 13 further comprising a parachute carried by said projectile of said second ammunition unit adjacent its said bottom member.

15. Ammunition as defined in claim 9 wherein said case of at least one of said ammunition units is a metal case.

16. Ammunition as defined in claim 15 wherein said case of each of said ammunition units extends axially essentially only over the rear section of the associated said payload projectile.

17. Ammunition as defined in claim 9 wherein said case of at least said second ammunition unit is at least in part combustible.

18. Ammunition as defined in claim 9 wherein said payload projectile of said second ammunition unit is a light producing projectile.

19. Ammunition as defined in claim 9 wherein said payload projectile of said second ammunition unit is a fog producing projectile.

20. Ammunition as defined in claim 9 wherein said case of said first ammunition unit is longer than said case of said second ammunition unit.

21. Ammunition as defined in claim 9 wherein said case of said second ammunition unit is longer than said case of said first ammunition unit.

22. Ammunition as defined in claim 9 further comprising a guide band disposed on the surface of said main cylindrical portion of said projectile of said second ammunition unit adjacent its said ogival front end portion.

23. Ammunition as defined in claim 22 wherein said case of said second ammunition unit extends axially over said main portion of said projectile of said second ammunition unit to said guide band.

24. Ammunition as defined in claim 23 said projectile of said second ammunition unit further includes an extendable flight path stabilizing tail unit connected to said projectile adjacent the rear end of said projectile.

25. Ammunition as defined in claim 23 wherein said case of said first ammunition unit extends axially essentially only over the rear section of said projectile of said first ammunition unit and is shorter than said case of said second ammunition unit.

* * * * *